US005246786A

United States Patent [19]

Usui

[11] Patent Number: 5,246,786

[45] Date of Patent: * Sep. 21, 1993

[54] STEEL PRODUCT WITH HEAT-RESISTANT, CORROSION-RESISTANT PLATING LAYERS

[75] Inventor: Masayoshi Usui, Numazu, Japan

[73] Assignee: Usui Kokusai Sangyo Kaisha Ltd., Shimizu, Japan

[ * ] Notice: The portion of the term of this patent subsequent to Oct. 22, 2008 has been disclaimed.

[21] Appl. No.: 900,795

[22] Filed: Jun. 22, 1992

Related U.S. Application Data

[63] Continuation of Ser. No. 726,426, Jul. 5, 1991, abandoned, which is a continuation of Ser. No. 545,670, Jun. 29, 1990, abandoned, which is a continuation of Ser. No. 418,358, Oct. 6, 1989, abandoned.

[30] Foreign Application Priority Data

Oct. 29, 1988 [JP] Japan ..... 63-274220

[51] Int. Cl.[5] ..... C23C 28/00

[52] U.S. Cl. ..... 428/621; 428/632; 428/658; 428/678; 428/679; 428/680; 428/926

[58] Field of Search ..... 428/632, 658, 659, 671, 428/674, 676, 677, 679, 680, 926, 621; 148/264, 265, 266, 267

[56] References Cited

U.S. PATENT DOCUMENTS

| | | | |
|---|---|---|---|
| 2,918,722 | 12/1959 | Kenmore | 428/677 |
| 4,190,504 | 2/1980 | Usui | 428/632 |
| 5,059,493 | 10/1991 | Takahata | 428/658 |

FOREIGN PATENT DOCUMENTS

| | | | |
|---|---|---|---|
| 60-165387 | 8/1985 | Japan | 428/679 |

*Primary Examiner*—R. Dean
*Assistant Examiner*—Robert R. Koehler
*Attorney, Agent, or Firm*—Nikaido, Marmelstein, Murray & Oram

[57] ABSTRACT

A steel product (or copper-plated steel product) with heat-resistant, corrosion-resistant plating layers which are composed of a 0.2–10 μm thick nickel plating layer formed on said steel product, a zinc plating layer formed on said nickel plating layer, and a chromate film formed on said zinc plating layer.

5 Claims, No Drawings

STEEL PRODUCT WITH HEAT-RESISTANT, CORROSION-RESISTANT PLATING LAYERS

This application is a continuation of application Ser. No. 07/726,426 filed Jul. 5, 1991, now abandoned which application is a continuation of prior application Ser. No. 07/545,670, filed Jun. 29, 1990, and which is a continuation of prior application Ser. No. 07/418,358, filed Oct. 6, 1989, both now abandoned.

BACKGROUND OF THE INVENTION

1. Field of the Invention

The present invention relates to a steel product with heat-resistant, corrosion-resistant plating layers, and more particularly, to a steel product such as sheets, pipes, couplings, clamps, bolts, and nuts used for automobiles and various machines and equipment, said steel product having heat-resistant, corrosion-resistant plating layers on the surface thereof.

2. Description of the Prior Art

It has been a common practice to form a zinc plating layer and then a chromate film on sheets, pipes, couplings, clamps, bolts, and nuts used for automobiles and various machines and equipment. Conventional plated steel products exhibit improved corrosion resistance in corrosive environments at normal temperature but they do not in high-temperature environments such as automotive engine rooms.

SUMMARY OF THE INVENTION

The present invention was completed to solve the above-mentioned problem. Accordingly, it is an object of the present invention to provide a steel product with plating layers which exhibits not only high corrosion resistance but also good heat resistance.

The present inventors carried out a series of researches which led to the finding that the object of the present invention is achieved if the plating layers are composed of a nickel plating layer of specific thickness (as the lower layer), a zinc plating layer (as the intermediate layer), and a chromate film (as the top layer). The present invention was completed on the basis of this finding. The gist of the present invention resides in a steel product (or copper-plated steel product) with heat-resistant, corrosion-resistant plating layers which are composed of a 0.2–10 μm thick nickel plating layer formed on said steel product, a zinc plating layer formed on said nickel plating layer, and a chromate film formed on said zinc plating layer.

DETAILED DESCRIPTION OF THE INVENTION

The steel product pertaining to the present invention includes sheets, pipes, couplings, clamps, bolts, nuts, and the like. The steel product also includes a comparatively thin lap-welded steel tube (10 mm or below in outside diameter) with copper plating for welding. (Such a steel tube may be used for automotive hydraulic and fuel piping.) It has three plating layers. The lower layer is a 0.2–10 μm thick nickel plating layer. With a thickness less than 0.2 μm, this layer does not cover the ground of a steel product completely, nor does it improve heat resistance and corrosion resistance so much. With a thickness in excess of 10 μm, this layer is liable to peel and crack during bending and hence does not improve corrosion resistance for its increased thickness. This nickel plating layer may be formed by electroplating using a Watts bath, which provides a plating layer having less stress. The intermediate layer is a zinc plating layer, which may be formed by electroplating using a zinc chloride bath or zinc sulfate bath. It is considered that this zinc plating layer forms a Zn—Ni diffusion layer at the interface between the zinc plating layer and the nickel plating layer, which contributes to the improved corrosion resistance in high-temperature environments. The top layer is a chromate film, which may be formed from a chromate solution or dichromate-sulfuric acid solution or a commercial chromate treating solution (e.g., Z-493, made by Dipsol Chemicals Co., Ltd.).

The thus obtained steel product with plating layers exhibits good corrosion resistance even in high-temperature environments and on its bent parts, as demonstrated in Examples which follow.

EXAMPLES

The invention will be described in more detail with reference to the following examples.

EXAMPLE 1

A lap-welded steel tube, measuring 8 mm in diameter, 0.7 mm in wall thickness, and 380 mm long, was made of cold rolled carbon steel sheet designated as SPCC according to JIS G-3141, with the surface thereof coated with an about 3-μm thick copper plating layer for welding. This tube underwent nickel plating in a Watts bath at a bath temperature of 52°–57° C. with a current density of 3 A/dm$^2$. The plating thickness ranged from 0.5 μm to 10 μm. The plated steel tube further underwent zinc plating for 15 minutes in a bath solution containing 28 g/L of ZnO, 50 g/L of NaCl, and 80 g/L of NaOH at a bath temperature of 25° C. with a current density of 3 A/dm$^2$. Thus there was formed an 8-μm thick zinc plating layer on the nickel plating layer. The zinc plating layer was further coated with a chromate film by dipping in a solution containing 10 mL/L of Z-493 (a product of Dipsol Chemicals Co., Ltd.) at a bath temperature of 25° C. for 20 seconds. Thus there was obtained a steel tube having plating layers.

The plated tube, with one end bent through 180° around a mandrel 25 mm in radius, was examined for corrosion resistance by salt spray test according to JIS Z-2371. The time (in days) required for red rust to occur was measured. The plated tube was also examined for heat resistance and corrosion resistance by heating at 200° C. for 24 hours and then by salt spray test according to JIS Z-2371. The time (in days) required for red rust to occur was measured. Both tests were carried out using two samples each. The results are shown in Table 1. (Sample Nos. 1 to 5.)

EXAMPLE 2

An electric welded steel tube of the same dimensions as in Example 1 was made of carbon steel designated as STPG-38 according to JIS G-3454. The steel tube was plated and tested in the same manner as Example 1. The results are shown in Table 1. (Sample Nos. 6 to 10.)

COMPARATIVE EXAMPLE 1

A lap-welded steel tube having plating layers and an electric welded steel tube having plating layers were produced in the same manner as in Examples 1 and 2, respectively, except that the nickel plating was 0.1 μm thick or 15 μm thick. The steel tubes were tested in the same manner as in Example 1. The results are shown in Table 1. (Sample Nos. 11 to 14.)

COMPARATIVE EXAMPLE 2

The same lap-welded steel tube as in Example 1 and the same electric welded steel tube as in Example 2 were provided with a zinc plating layer and chromate film, without the formation of a nickel plating layer, in the same manner as in Example 1. The steel tubes were tested in the same manner as in Example 1. The results are shown in Table 1. (Sample Nos. 15 and 16.)

TABLE 1

| Example No. | Sample No. | Steel tube* | Thickness of nickel plating (μm) | Thickness of zinc plating (μm) | Corrosion resistance** | | Heat and corrosion resistance** | |
|---|---|---|---|---|---|---|---|---|
| | | | | | Bent part | Straight part | Bent part | Straight part |
| 1 | 1 | A | 0.5 | 8 | 360 | 720 | 192 | 360 |
| 1 | 2 | A | 1.0 | 8 | 360 | 720 | 192 | 480 |
| 1 | 3 | A | 2.5 | 8 | 408 | 960 | 216 | 528 |
| 1 | 4 | A | 5.0 | 8 | 480 | 1008 | 240 | 600 |
| 1 | 5 | A | 10.0 | 8 | 408 | 1008 | 216 | 600 |
| 2 | 6 | B | 0.5 | 8 | 312 | 672 | 216 | 360 |
| 2 | 7 | B | 1.0 | 8 | 360 | 768 | 216 | 360 |
| 2 | 8 | B | 2.5 | 8 | 456 | 960 | 240 | 480 |
| 2 | 9 | B | 5.0 | 8 | 480 | 1008 | 264 | 600 |
| 2 | 10 | B | 10.0 | 8 | 408 | 960 | 240 | 528 |
| (1) | 11 | A | 0.1 | 8 | 360 | 600 | 48 | 96 |
| (1) | 12 | A | 15.0 | 8 | 288 | 1008 | 120 | 600 |
| (1) | 13 | B | 0.1 | 8 | 312 | 600 | 48 | 96 |
| (1) | 14 | B | 15.0 | 8 | 288 | 960 | 120 | 600 |
| (2) | 15 | A | — | 8 | 360 | 600 | 24 | 24 |
| (2) | 16 | B | — | 8 | 312 | 552 | 48 | 48 |

*A: lap-welded steel tube, B: electric welded steel tube
**Time (in days) required for red rust to occur.
Parenthesized numbers indicate Comparative Examples.

The steel product of the present invention has plating layers formed on top of the other, the lower layer being a nickel plating layer having a specific thickness, the intermediate layer being a zinc plating layer, and the top layer being a chromate film. Owing to the plating layers, it exhibits outstanding corrosion resistance and retains it even after heat treatment or on its bent parts. Therefore, it is suitable for use in high-temperature environments such as automotive engine-room.

What is claimed is:

1. A steel product composed of a steel substrate with heat-resistant, corrosion-resistant plating layers which are composed of a 0.2–10 μm thick nickel plating layer formed on said steel substrate, a zinc plating layer formed on said nickel plating layer, and a chromate film formed on said zinc plating layer.

2. A steel product as claimed in claim 1, wherein the nickel plating layer is one which is formed by electroplating using a Watts bath.

3. A steel product as claimed in claim 1, wherein the zinc plating layer is one which is formed by electroplating using a zinc chloride bath or zinc sulfate bath.

4. A steel product as claimed in claim 1, wherein said chromate film is one which is formed from a chromate solution or dichromate-sulfuric acid solution.

5. A steel product as claimed in claim 1, wherein said chromate film is one which is formed from a chromate treating solution for zinc plating.

* * * * *